US011715479B1

(12) United States Patent
Faundez Hoffmann et al.

(10) Patent No.: US 11,715,479 B1
(45) Date of Patent: Aug. 1, 2023

(54) SIGNAL ENHANCEMENT AND NOISE REDUCTION WITH BINAURAL CUE PRESERVATION CONTROL BASED ON INTERAURAL COHERENCE

(71) Applicant: META PLATFORMS TECHNOLOGIES, LLC, Menlo Park, CA (US)

(72) Inventors: Pablo Francisco Faundez Hoffmann, Kenmore, WA (US); Anjali Induchoodan Menon, Redmond, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 24 days.

(21) Appl. No.: 17/389,946

(22) Filed: Jul. 30, 2021

(51) Int. Cl.

| | |
|---|---|
| ***G10L 21/0224*** | (2013.01) |
| ***H04R 3/04*** | (2006.01) |
| ***H04R 5/04*** | (2006.01) |
| ***H04S 1/00*** | (2006.01) |
| ***H04S 7/00*** | (2006.01) |
| *G10L 21/0216* | (2013.01) |
| *H04R 5/033* | (2006.01) |

(52) U.S. Cl.
CPC ..... *G10L 21/0224* (2013.01); *H04R 3/04* (2013.01); *H04R 5/04* (2013.01); *H04S 1/002* (2013.01); *H04S 7/307* (2013.01); *G10L 2021/02166* (2013.01); *H04R 5/033* (2013.01)

(58) Field of Classification Search
None
See application file for complete search history.

(56) References Cited

U.S. PATENT DOCUMENTS

2010/0002886 A1* 1/2010 Doclo ..... H04R 25/407 381/23.1
2013/0129124 A1* 5/2013 Westermann ..... H04R 25/552 381/312

OTHER PUBLICATIONS

Marquardt, Daniel, et al. "Interaural Coherence Preservation in Multi-Channel Wiener Filtering-Based Noise Reduction for Binaural Hearing Aids." IEEE/ACM Transactions on Audio, Speech, and Language Processing, vol. 23, No. 12, Dec. 2015, pp. 2162-2176. (Year: 2015).*

* cited by examiner

*Primary Examiner* — James K Mooney
(74) *Attorney, Agent, or Firm* — Fenwick & West LLP

(57) ABSTRACT

An audio signal is enhanced using interaural coherence to control noise reduction and binaural cue preservation. Sounds from a local area are detected via an acoustic array. An interaural coherence is determined using the detected sounds. Sound filters for an audio signal are generated based on the interaural coherence. The sound filters implement a tradeoff between increasing signal-to-noise ratio (SNR) between a target source and an interfering source and preserving of binaural information of the interfering source. The tradeoff is controlled based on the interaural coherence. The sound filters are applied to the audio signal to generate audio content. The audio content is presented via a speaker array.

20 Claims, 9 Drawing Sheets

500

600

700

SIGNAL ENHANCEMENT AND NOISE REDUCTION WITH BINAURAL CUE PRESERVATION CONTROL BASED ON INTERAURAL COHERENCE

FIELD OF THE INVENTION

This disclosure relates generally to audio signal enhancement, and more specifically to reducing noise while preserving binaural information.

BACKGROUND

Multichannel audio signal processing methods aimed at enhancing target sources and suppressing (e.g., undesired) interfering sources. These methods typically collapse all input channels (e.g., from multiple microphones in a microphone array), into a mono channel. The target source may include a portion of the sounds in a local area corresponding with speech or other sounds from a target source and an interfering source may include another portion of the sounds in the local corresponding with speech or other sounds from a nontarget source. While these methods can provide significant suppression of interfering sources, collapsing all input channels into a mono channel results in distorting or completely removing the spatial information of the target and interfering sources.

SUMMARY

Embodiments relate to enhancing an audio signal by using interaural coherence (IC) to control a tradeoff between signal-to-noise ratio (SNR) and binaural quality. Some embodiments include a method performed by one or more processors. The method includes detecting, via an acoustic sensor array, sounds from a local area. The method includes determining an interaural coherence using the detected sounds. The method further includes generating sound filters for an audio signal based on the interaural coherence. The sound filters implement a tradeoff between increasing SNR between a target source and interfering source(s) and preserving of binaural information of the interfering source(s). The tradeoff is controlled based on the interaural coherence. The method further includes applying the sound filters to the audio signal to generate audio content and presenting the audio content via a speaker array.

Some embodiments include a device. The device includes an acoustic sensor array configured to detect sounds from a local area, a speaker array, one or more processors, and a memory. The memory stores program code, when executed by the one or more processors, configures the one or more processors for: determining an interaural coherence using the detected sounds; generating sound filters for an audio signal based on the interaural coherence, the sound filters implementing a tradeoff between increasing signal-to-noise ratio (SNR) between a target source and an interfering source and preserving of binaural information of the interfering source, the tradeoff being controlled based on the interaural coherence; applying the sound filters to the audio signal to generate audio content; and presenting, via the speaker array, the audio content.

Some embodiments include a non-transitory computer-readable medium including stored program code that, when executed one or more processors of an audio system, configures the audio system to: detect, via an acoustic sensor array, sounds from a local area; determine an interaural coherence using the detected sounds; generate sound filters for an audio signal based on the interaural coherence, the sound filters implementing a tradeoff between increasing SNR between a target source and an interfering source and preserving of binaural information of the interfering source, the tradeoff being controlled based on the interaural coherence; apply the sound filters to the audio signal to generate audio content; and present, via a speaker array, the audio content.

Figure 1A:
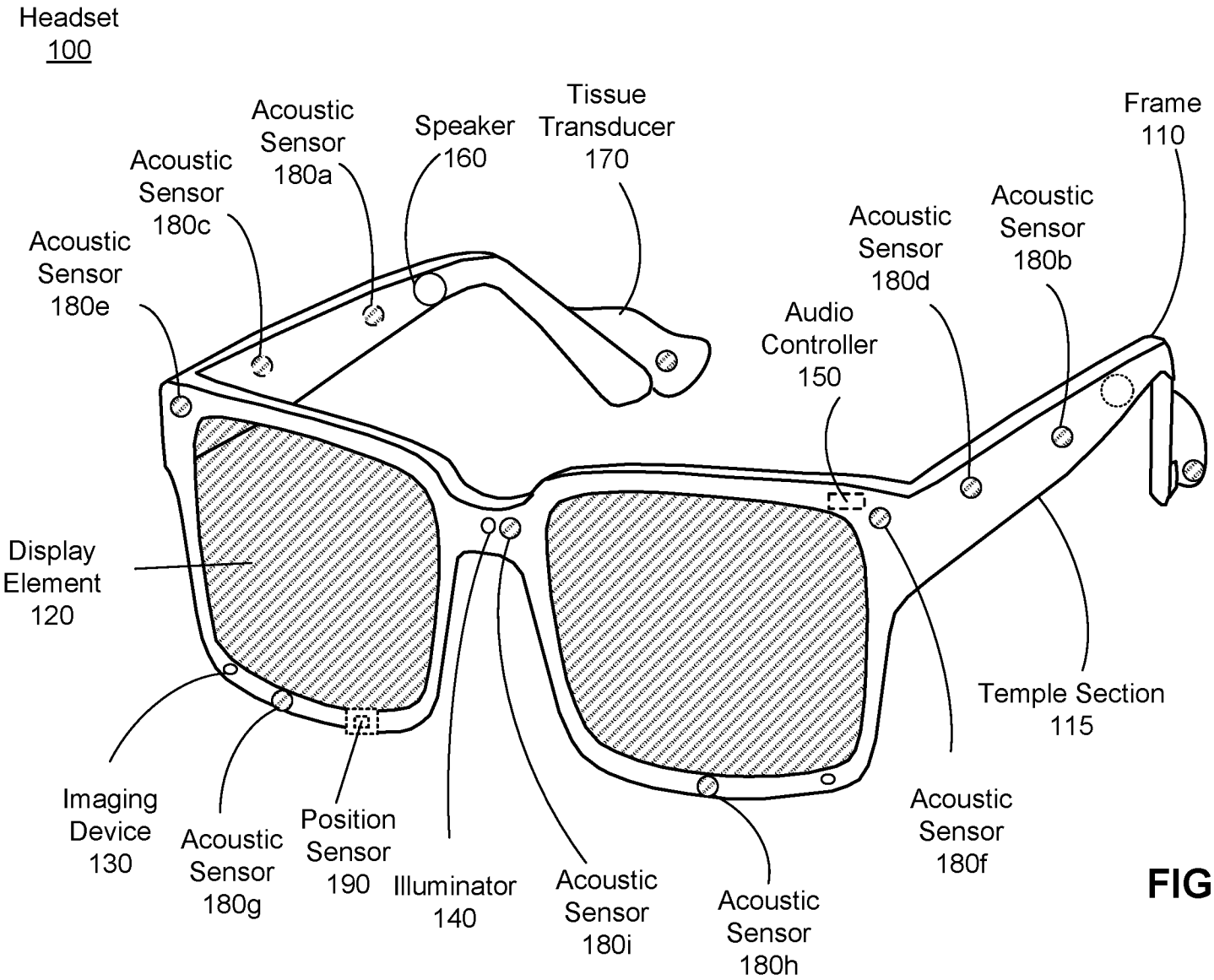
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Array signal processing for enhancing a target sound source (e.g., speech) while preserving its binaural information as well as the binaural information of interfering sound sources do so at the expense of a decreased SNR, also referred to as target-sound-to-interferer ratio. The more accurate the preserved binaural information the more reduced the SNR. While it is possible to increase the independency between binaural information and SNR, such techniques involve high computational complexity.

Embodiments relate to using interaural coherence between left and right channels of detected sounds to select an appropriate audio processing in terms of a tradeoff between SNR and binaural quality. Interaural coherence is used to control (e.g., optimize) the tradeoff because the perceptual importance of the preserved binaural information depends on the actual correlation between binaural channels. Low interaural coherence corresponds with reverberant environments where diffuseness of sound is more dominant.

It is more difficult to detect spatial cues in such environments, and thus there is less need to preserve binaural information and SNR can be prioritized. When the interaural coherence is low (e.g., below a threshold value), the audio processing prioritizes SNR. This is achieved by generating and applying a filter that enhances the target source relative to an interfering source. When the interaural coherence is high (e.g., above a threshold value), the audio processing prioritizes preserving binaural information of the interfering source. This is achieved by generating and applying a filter that uses a combination of SNR, signal distortion, and interference binaural information of one or more interfering sound sources.

As such, control of the tradeoff between SNR and binaural quality is improved or optimized, without requiring the high computational complexity that would be needed to increase the independency between binaural information and SNR.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The detected sounds may be used to determine properties that are used to generate and apply filters to audio signals. The sensor array includes a plurality of acoustic sensors 180*a* through 180*i* (individually referred to as acoustic sensor 180). An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 provides for enhancing an audio signal by using interaural coherence, as well as other properties of detected sounds, to control a tradeoff between SNR and binaural quality. The audio controller 150 may comprise one or more processors and a computer-readable storage medium. The computer-readable storage medium includes instructions that, when executed by the one or more processors, configures the one or more processors to perform the functionality discussed herein by the audio controller 150. In some embodiments, the audio controller 150 may include an application specific integrated circuit (ASIC), a field programmable gate array (FPGA), or some other type of processing circuitry.

The audio controller 150 receives sounds for a local area detected by the sensor array. The sounds may be received from a pair of acoustic sensors 180 (e.g., acoustic sensor 180*a* on the right side of the headset 100 and acoustic sensor 180*b* on the left side of the headset 100) or multiple left-right pairs of acoustic sensors 180 (e.g., a first pair including acoustic sensors 180*a* and 180*b*, a second pair including 180*c* and 180*d*, a third pair including 180*e* and 180*f*, etc.). The audio controller 150 generates a left channel and a right channel (also referred to as left and right "reference" channels) using the detected sounds. The left and right channels may include binaural information for one or more target sources and one or more interfering sources.

The audio controller 150 determines properties of the detected sounds including an interaural coherence between the left and right channel, interaural time difference (ITD) between the left and right channels for a target source, ITD between the left and right channels for an interfering source, ITD just noticeable difference (ITD JND) of the target source, ITD JND of the interfering source, and binaural release from masking (BRFM) for the angle of separation between the target and interfering sound sources.

Interaural coherence is a measure of the similarity of sounds at the two ears. Interaural coherence is related to the diffuseness of the sound field. ITD defines a difference in arrival time of sound between two ears. ITD JND refers to a threshold level for the ITD can be detected by a user. BFRM is a phenomenon in auditory perception wherein the detection and identification of a signal in noise improves when the signal and noise sources are spatially separated.

The audio controller 150 generates sound filters for an audio signal based on the properties of the detected sounds. The sound filters implement a tradeoff between increasing SNR between a target source and interfering source(s) and preserving of binaural information of the interfering source(s). The tradeoff is controlled based on the interaural coherence. The audio controller 150 applies the sound filters to an audio signal to generate audio content and presents the audio content via a speaker array. Additional details regarding enhancing an audio signal by using interaural coherence and other properties of detected sounds are discussed below in connection with FIGS. 2 through 7.

The audio controller 150 processes information from the sensor array that describes sounds detected by the sensor array. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof.

The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 6.

Figure 1B:
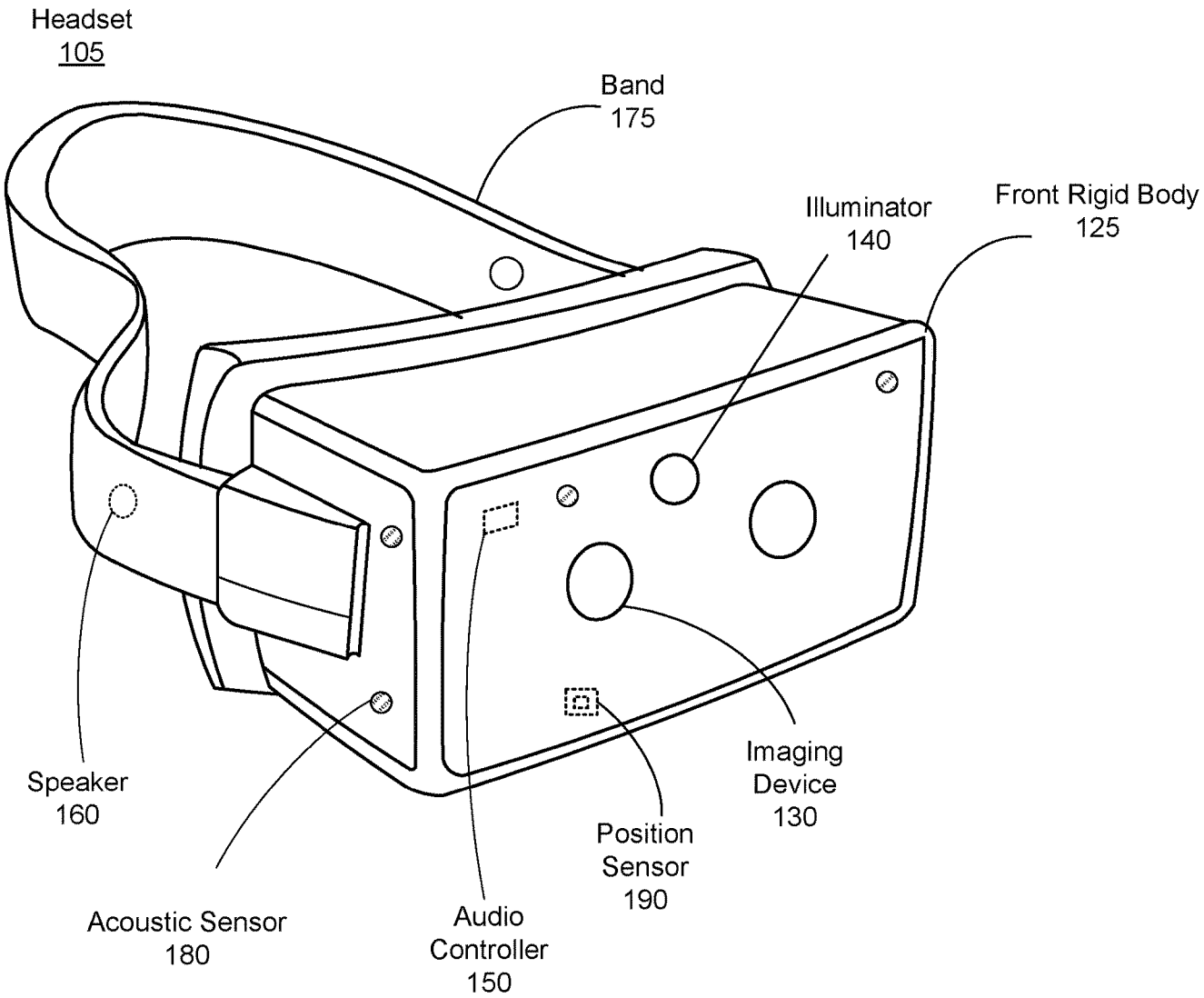
FIG. 1B is a perspective view of a headset implemented as a head-mounted display, in accordance with one or more embodiments.

FIG. 1B is a perspective view of a headset 105 implemented as an HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user.

Figure 2:
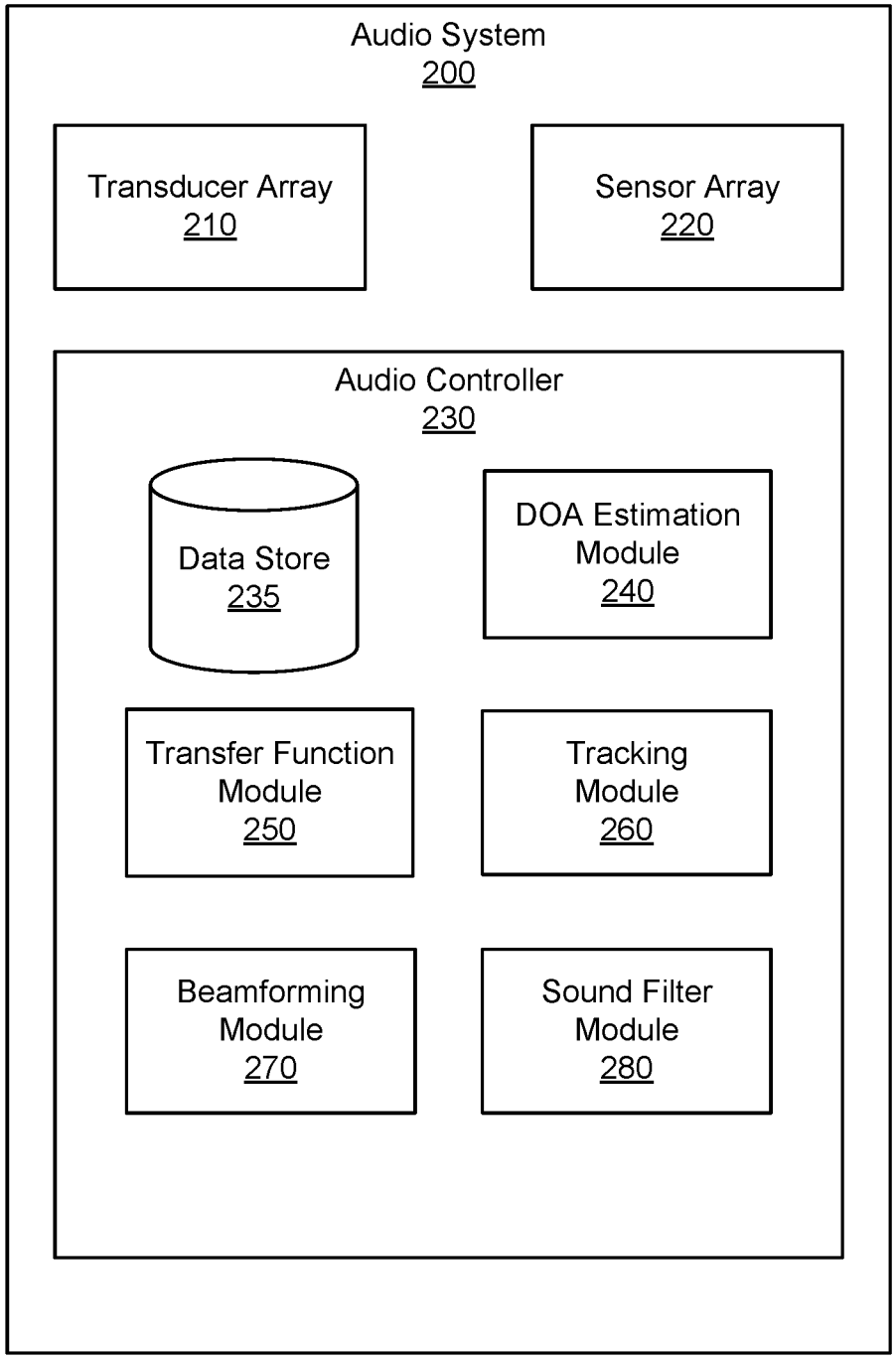
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 (also referred to as a speaker array) generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, and a sound filter module 280. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset. The user may opt in to allow the audio controller 230 to transmit data captured by the headset to systems external to the headset, and the user may select privacy settings controlling access to any such data.

The data store 235 stores data for use by the audio system 200. Data in the data store 235 may include sounds recorded in the local area of the audio system 200, audio signals and filtered audio content, interaural coherences, ITDs of target and interfering sources, ITD JNDs of target and interfering sound sources, and BRFM thresholds, relationships between ITD JND, interaural coherence, and ITD, relationships between BRFM thresholds and angles of separation between target and interfering sound sources, and relationships between SNR, interaural coherence, and filter parameters. The data store 235 may also store head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, or any combination thereof.

The DOA estimation module 240 is configured to localize sound sources in the local area based in part on information from the sensor array 220. Localization is a process of determining where sound sources (e.g., including target and interfering sources) are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 provides for enhancing audio signals by using interaural coherence to control a tradeoff between increasing SNR between a target source and an interfering source and preserving of binaural information of the interfering source (also referred to as binaural quality). In some embodiments, the sound filter module 280 uses a binaural multichannel Wiener filter with noise estimation (BMWF-N) to control the tradeoff between SNR and binaural quality. For an audio signal with left and right reference channels (e.g., generated from detected sounds), the BMWF-N is defined by Equations 1 and 2:

$$W_L = \arg\min\{\|X_L - W_L^H X\|^2 + \mu\|\eta V_L - W_L^H V\|^2\} \quad (1)$$

$$W_R = \arg\min\{\|X_R - W_R^H X\|^2 + \mu\|\eta V_R - W_R^H V\|^2\} \quad (2)$$

where $W_L$ and $W_R$ are filters respectively for the left and right channels, $X_L$ and $X_R$ are respectively the desired source signal at the left and right reference channels (e.g., as captured by acoustic sensors 180*b* and 180*a*, respectively), V is a matrix containing the noise signal representing spatial noise, diffused noise, etc. from all the sensors, X is a matrix containing the desired source signal from all the sensors (including the two reference channels $X_L$ and $X_R$), μ controls a tradeoff between SNR and speech distortion (SD), which may result in less intelligible target speech as well as more impaired binaural information, and η controls the preservation of the binaural information of the interfering source(s). Speech Distortion is the ratio of the average input Power Spectral Density (PSD) of the desired source component in the reference channels and the average output PSD of the desired source component. The channels $X_L$ and $X_R$ are reference channels of a binaural audio signal including one or more target sources and one or more interfering sources. Each of these sources may include a DOA that is represented in the binaural information of the audio signal.

The term $\|X_L - W_L^H X\|^2$ in Equation 1 and the term $\|X_R - W_R^H X\|^2$ in Equation 2 are each responsible for making the filtered target source similar to the target source in the input channels $X_L$ and $X_R$. These are filters are independently optimized to capture the target source with minimal spectral and temporal distortion. The consequence of having the two reference microphones placed at opposite sides of the head is the preservation of the target binaural information. The term $\|\eta V_L - W_L^H V\|^2$ in Equation 1 and the term $\|\eta V_R - W_R^H V\|^2$ in Equation 2 are each responsible for reducing the filtered interfering source to a scaled version of the interfering source in the reference channel, thus controlling the amount of preservation of the binaural information of the interfering source.

In some embodiments, the sound filter module 280 is not limited to use of BMWF-N to control the tradeoff between SNR and binaural quality. Other types of filters may be used. For example, variations of the BMWF may be used that have different constraints on the filter. BMWF-RTF preserves the spatial characteristics of the noise component and the parameters μ, α and κ are used to adjust the tradeoffs between speech distortion, binaural quality and noise suppression. Other methods like BMWF, BMWF-IR, BLCMV etc., all of which have different sets of constraints may also be used.

The sound filter module 280 uses interaural coherence, as well as other properties of the detected sounds as captured by the reference signals $X_L$ and $X_R$, to control the parameters μ and η in Equations 1 and 2. Via the setting of μ and η, the sound filter module 28-0 control the tradeoff between SNR and preserving binaural information of the interferer. For a given SNR, the accuracy of the preserved binaural information depends on the diffuseness of the sound field. From a perception viewpoint, the more diffuse the sound field the less critical it is to preserve the binaural information of directional sources. The interaural coherence is generally proportional to the diffuseness of the sound field. This means that if the interaural coherence is low, then SNR may be prioritized or maximized because the binaural information will not be easily discerned. If the interaural coherence is high, a combination of SNR, SD, and interference binaural information may be achieved by using properties of the detected sounds including ITD, ITD JND, and BRFM. Additional details regarding the determination of the parameters μ and η in Equations 1 and 2 are discussed below in connection with FIGS. 3 through 7.

After creating the sound filters, the sound filter module 280 applies the sound filters to an audio signal to generate audio content. The audio signal may be the same as the reference channels generated from the detected sounds or may be different. The audio content is presented via the transducer array 210.

The sound filter module 280 may enhance a broadband audio signal or one or more subbands of an audio signal. In some embodiments, different subbands of the audio signal may be processed separately. For example, the sound filter module 280 may determine a frequency-dependent interaural coherence for a subband defining an audio frequency range, generate sound filters for the subband based on the interaural coherence, and apply the sound filters to the subband of an audio signal. The frequency analysis into subband may use different subband strategies depending on the application and desired complexity. For low complexity we may separate the audio frequency range in low, mid, and high frequencies. A higher frequency resolution may use a higher number of bands with typical numbers between 32 and 64 bands. These bands may be distributed uniformly or non-uniformly over frequency. The non-uniform distribution may be used to better approximate the frequency analysis of the ear. Since we are using ITD information, a baseline subband analysis may divide the frequency range into a low-frequency region where the ITD is dominant (e.g., f<1.5 kHz) and a high-frequency region.

The sound filter module 280 may also determine sound filters for the transducer array 210. The sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below with regard to FIG. 6).

The sound filter module 280 provides audio content processed using the sound filters to the transducer array 210. In some embodiments, the sound filters may cause positive or negative amplification of sounds as a function of frequency.

Figure 3:
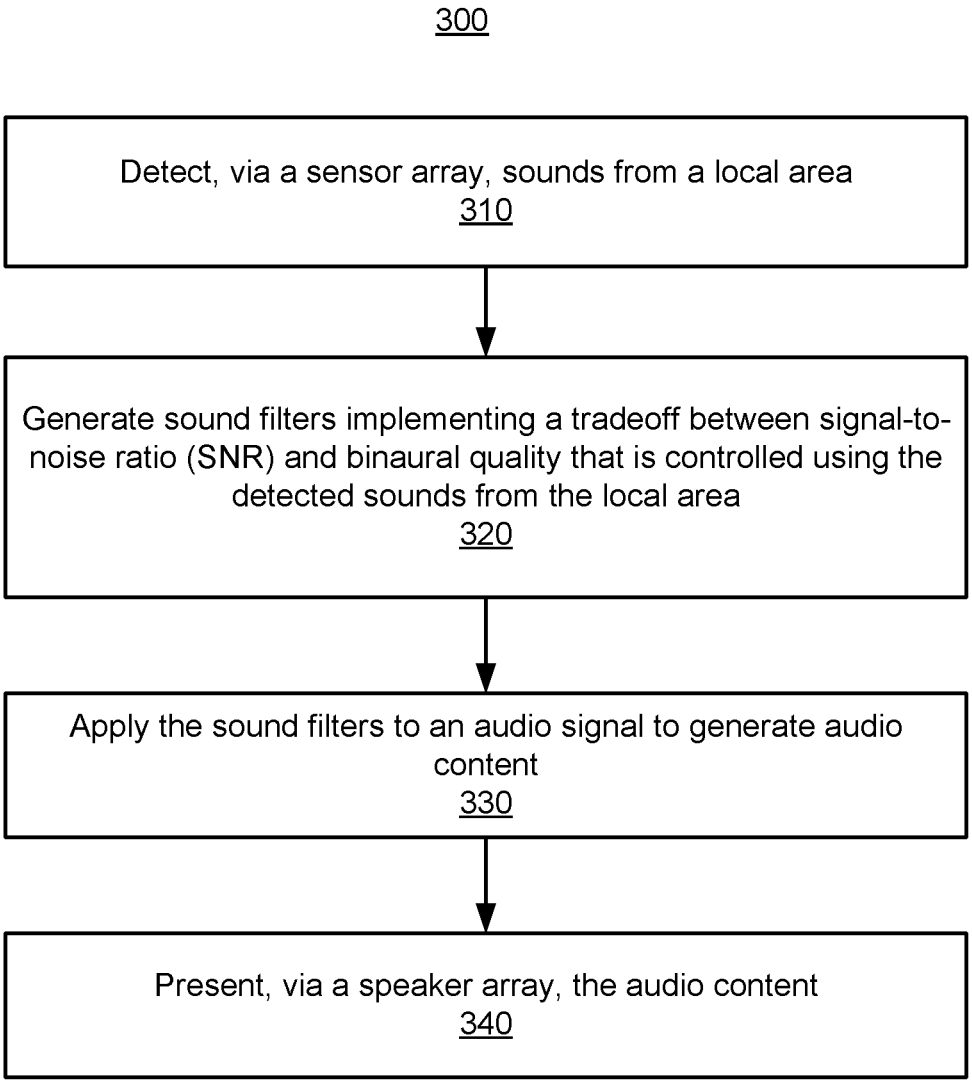
FIG. 3 is a flowchart illustrating an example of a process for enhancing an audio signal using detected sounds in a local area, in accordance with one or more embodiments.

FIG. 3 is a flowchart illustrating an example of a process 300 for enhancing an audio signal using detected sounds in a local area, in accordance with one or more embodiments. The process shown in FIG. 3 may be performed by components of an audio system (e.g., audio system 200). Other entities may perform some or all of the steps in FIG. 3 in other embodiments. Embodiments may include different and/or additional steps, or perform the steps in different orders.

The audio system detects 310, via a sensor array, sounds from a local area. The sensor array may include a pair of acoustic sensors (e.g., acoustic sensors 180*a* and 180*b*), or multiple (e.g., left-right) pairs of acoustic sensors. In some embodiments, other than the reference acoustic sensors being a pair (such as binaural microphones) or in pairs, there are no additional constraints for any of the other acoustic sensors to be pairs. The placement of other acoustic sensors may depend on other factors such as optimizing SNR, DOA estimation accuracy, etc. The sound detected by the sensor array are used to generate a left reference channel and a right reference channel. The left and right reference channels may include binaural information related to target and interfering sound sources.

The audio system (e.g., sound filter module 280) generates 320 sound filters implementing a tradeoff between SNR and binaural quality that is controlled using the detected sounds from the local area. The sound filters may include the sound filters $W_L$ and $W_R$ of the BMWF-N as defined by Equations 1 and 2 or may include other types of sound filters that are capable of implementing the tradeoff (e.g., using the parameters μ and η). The parameters μ and η may be determined using the detected sounds. For example, the audio system uses the left and right reference channels to determine the interaural coherence, ITDs for target sources and interfering sources, ITD JNDs for target sources and interfering sources, and BRFM based on the angular separation of the target and interfere sources. These values may be used to determine the parameters μ and η, as discussed in greater detail below in connection with FIG. 4.

The audio system applies 330 the sound filters to an audio signal to generate audio content. The application of the filter $W_L$ to the input X yields the left channel of the output and similarly, applying the filter $W_R$ to the input X yields the right channel of the output. The left and right channels may be the left and right reference channels or may be different left and right channels of a different audio signal. The generated audio content includes the filtered left and right channels.

The audio system presents 340 the audio content via a speaker array. For example, the left channel may be provided to a left speaker and the right channel may be provided to a right speaker. In some embodiments, the audio content may include more than two channels. Each of the channels may be filtered and the result (e.g., binaural output) may be provided to a respective speaker of the speaker array.

The process 300 may be repeated. For example, the audio system may continue to detect sounds from the local area. The sounds may change over time, resulting in changes in the interaural coherence, ITDs, ITD JNDs, or BRFM. The sound filters may be updated and applied accordingly. In some embodiments, the sound filters are updated over time according to a predefined update rate.

In some embodiments, the process 300 may be performed on one or more subbands of the detected sounds and the audio signal. Different subbands may include different interaural coherence, ITDs, ITD JNDs, or BRFM, resulting in different sound filters being applied to different subbands of the audio signal.

Figure 4:
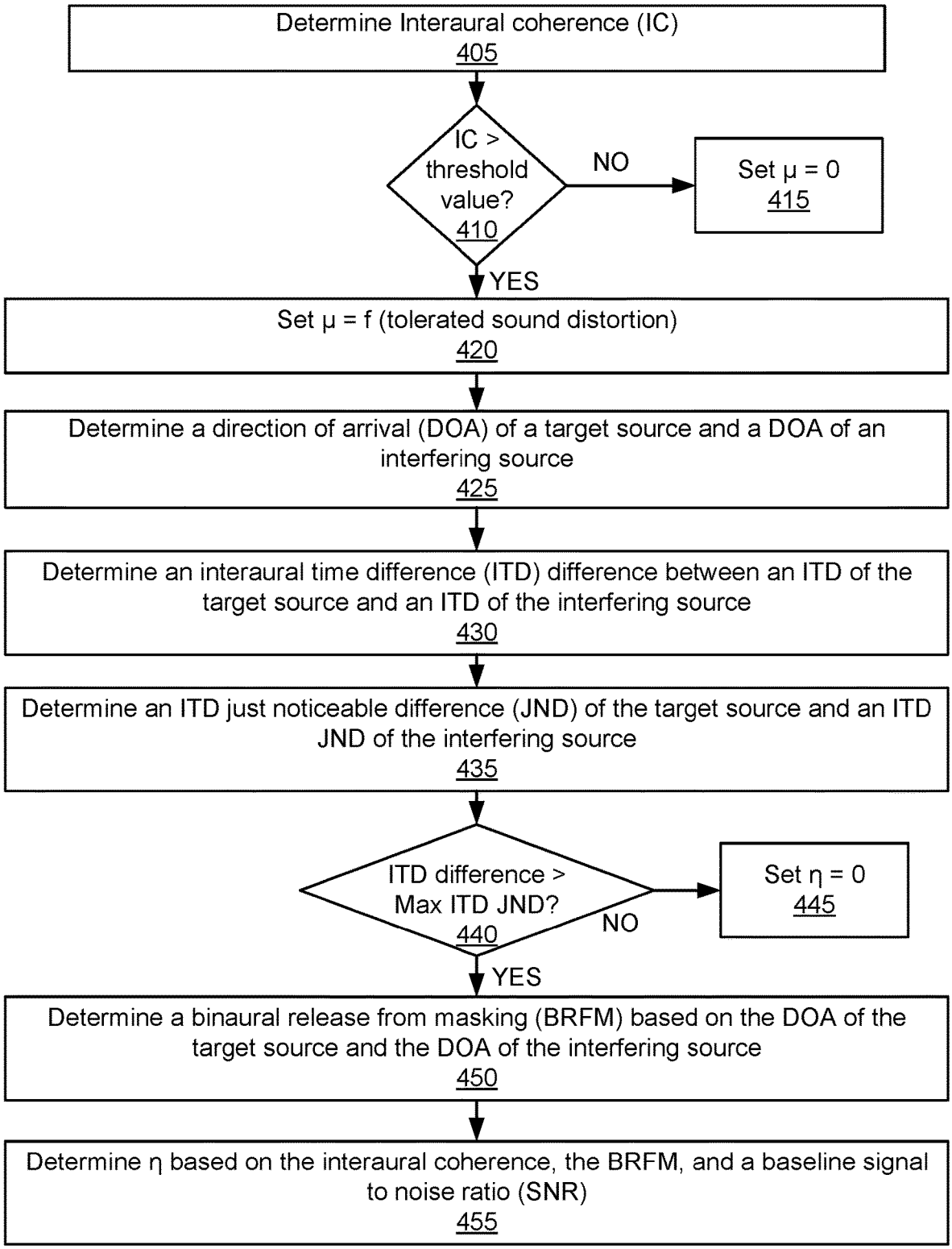
FIG. 4 is a flowchart illustrating an example of a process for generating sound filters for enhancing an audio signal using detected sounds in a local area, in accordance with one or more embodiments

FIG. 4 is a flowchart illustrating an example of a process 400 for generating sound filters for enhancing an audio signal using detected sounds in a local area, in accordance with one or more embodiments. The process 400 may be performed in step 320 of the process 300 shown in FIG. 3. The process 400 is performed to determine, based on the detected sounds, the parameters μ and η for the sound filters $W_L$ and $W_R$ as defined by Equations 1 and 2. The process shown in FIG. 4 may be performed by components of an audio system (e.g., audio system 200). Other entities may perform some or all of the steps in FIG. 4 in other embodiments. Embodiments may include different and/or additional steps, or perform the steps in different orders.

The audio system (e.g., sound filter module 280) determines 405 an interaural coherence between a left reference channel and a right reference channel generated from detected sounds from a local area. The left reference channel may be generated by using sound detected from one or more acoustic sensors at the left side of a user (e.g., acoustic sensors 180*b*, 180*d*, 180*f*, etc.) and the right reference channel may be generated by using sound detected by one or more acoustic sensors at the right side of the user (e.g., acoustic sensors 180*a*, 180*c*, 180*e*, etc.). The interaural coherence may be computed in the time domain as the value of the maximum of the normalized cross-correlation between the left signal xL(t) and the right signal xR(t). In the frequency domain the interaural coherence is computed by C(f)=|SxLxR(f)|^2/(SxLxL(f)*SxRxR(f)) where SxLxR(f) is the cross-spectrum between XL and XR and SxLxL(f) is the auto-spectrum of XL and SxRxR(f) is the auto-spectrum of XR. The interaural coherence varies between 0 and 1.

The audio system determines 410 whether the interaural coherence is greater than or less than a threshold value. The threshold value defines a level that differentiates between high and low levels of interaural coherence. The threshold value may be adjustable, either programmatically or by a user. The audio system compares the interaural coherence to the threshold level to determine the value of μ. The interaural coherence in very dry environments may be close to 1. In more typical rooms (e.g. a living room), with reverberation times around 300 milliseconds, the interaural coherence may vary between 0.8 and 0.9. For very reverberant environments, the interaural coherence may be around 0.4 or lower. Low levels of interaural coherence correspond with more reverberant environments where diffuseness of sound is more dominant and thus preserving binaural information is less important, while high levels of interaural coherence correspond with less reverberant environments where preserving binaural information is more important.

If the interaural coherence is less than (e.g., or equal to) the threshold value, the audio system sets 415 μ to 0 in Equations 1 and 2. This results in the BMWF-N algorithm of Equations 1 and 2 being set to a binaural minimum-variance distortion-less response (MVDR) algorithm that prioritizes processing for SNR, as defined by Equations 3 and 4, respectively.

$$W_L=\arg\min\{\|X_L-W_L^H X\|^2\} \tag{3}$$

$$W_R=\arg\min\{\|X_R-W_R^H X\|^2\} \tag{2}$$

The filter weights for $W_L$ and $W_R$ as defined by Equations 3 and 4 prioritize increasing SNR in the tradeoff between increasing SNR (e.g., including the binaural information of the target source) and preserving of binaural information of the interfering source. Prioritizing processing for the SNR may include increasing the sound level of the target source relative to background noise, including one or more interfering sources.

If the interaural coherence is greater than the threshold value, the audio system in steps 420-455 prioritizes preserving of binaural information more than when the interaural coherence is less than the threshold value in the tradeoff between increasing SNR and preserving of binaural information. For example, the audio system may determine filter weights that may optimize a combination of SNR, signal distortion, and preservation of interfering source binaural information, as discussed in greater detail below.

If the interaural coherence is greater than the threshold value, the audio system sets 420 μ to a value selected according to tolerated sound distortion (SD) as defined by Equation 5:

$$\mu=f(\text{tolerated } SD) \tag{5}$$

where f( ) is a function that can take several shapes but always results in monotonically increasing μ with increasing tolerated SD. As discussed above, μ controls a tradeoff between noise reduction and target sound distortion. Higher values for μ results in higher prioritization of noise reduction at the expense of more distortion, and lower values for μ results in higher prioritization of reduced distortion. Here, sound distortion refers primarily to distortions introduced to the target source which may result in reduction of intelligibility or binaural information of the target.

In steps 425-455, the audio system determines the parameter η in Equations 1 and 2 in response to the interaural coherence being greater than the threshold value (e.g., when μ is non-zero). The parameter η may be determined based on properties of the detected sounds including the interaural coherence and the angular separation between the target source and the interfering source.

To determine η, the audio system determines 425 a DOA of the target source and a DOA of the interfering source. In some embodiments, the DOA estimation module 240 determines the DOAs of the target and interfering sources. The DOA of the target and interfering sources may be determined using the sounds captured by the sensor array 220. The DOA estimation module 240 may analyze the intensity, spectra, and/or arrival time of each sound at the sensor array 230 to determine the direction from which the sounds originated.

The audio system determines 430 an ITD difference between an ITD of the target source and an ITD of the interfering source. The audio system estimates the ITD for the target source and the ITD for the interfering source. ITD refers to the difference in arrival time of a sound between the left and right ears. The sound at the left ear may be captured by the acoustic sensor 180*b* and the sound at the right ear may be captured by the acoustic sensor 180*a*. The ITD difference is determined as the difference between the ITD for the target source and the ITD for the interfering source. Differences in the DOA of the target and interfering sources may result in the difference in the ITDs of the target and interfering sources.

Figure 5:
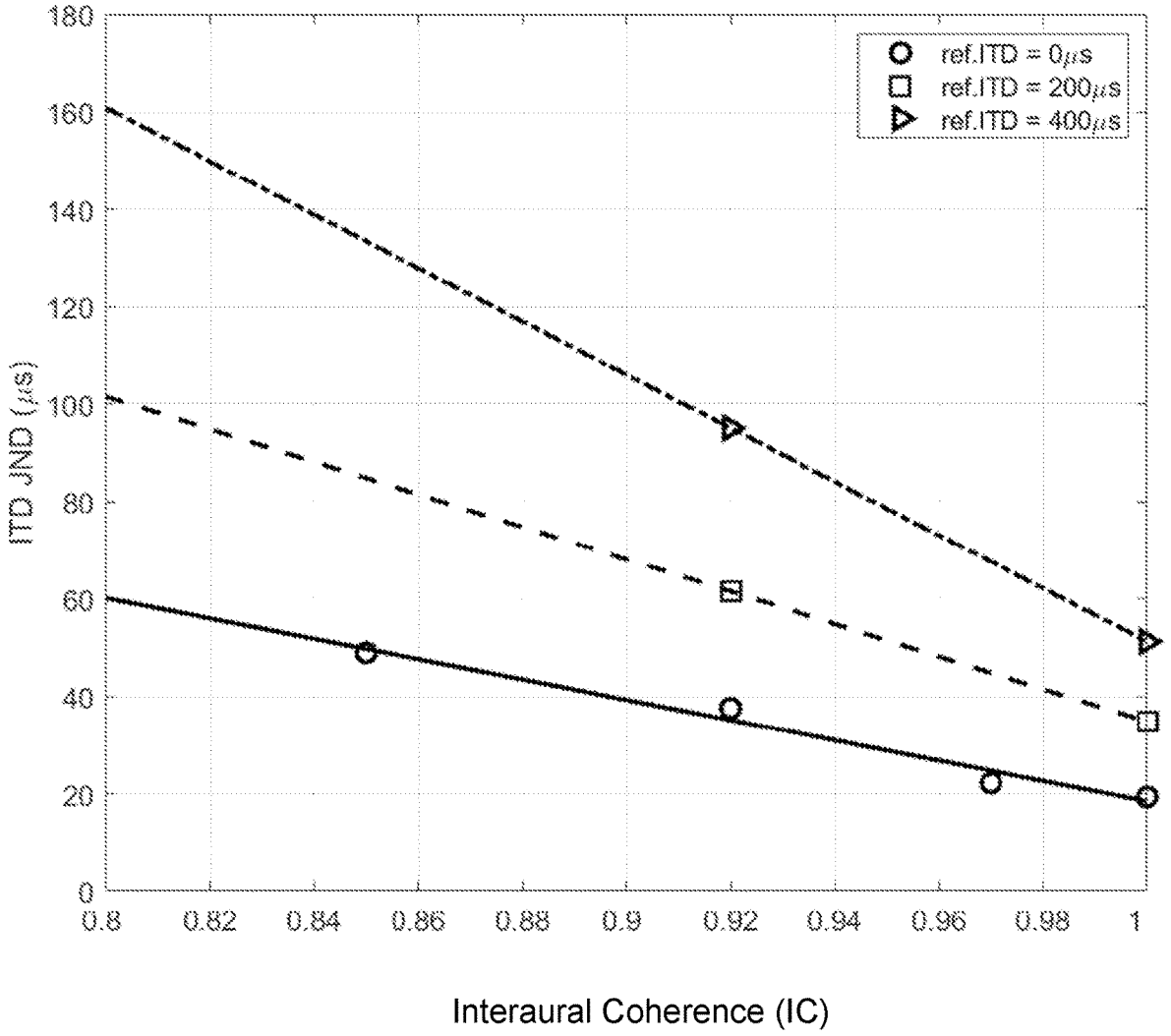
FIG. 5 is a graph of relationships between interaural coherence and interaural time difference just noticeable difference for different interaural time differences, in accordance with one or more embodiments.

The audio system determines 435 an ITD JND for the target source and an ITD JND for the interfering source. The ITD JND of a sound source is a function of interaural coherence and the ITD of the sound source. The audio system may store these relationships and use the stored relationships to determine the ITD JNDs based on measured ITD and interaural coherences for each of the target source and the interfering source. In some embodiments, these relationships may be determined experimentally. In general, the ITD JND decreases as the interaural coherence increases (e.g., for any ITD value). Furthermore, the ITD JND increases for increasing ITD (e.g., for any IC value). Example relationships between ITD JND, ITD, and interaural coherence are shown in FIG. 5, which is discussed in greater detail below.

The audio system determines 440, for the interaural coherence, whether the ITD difference between the target source and the interfering source is greater than or less than a maximum ITD JND of the target source and the interfering source. The maximum ITD JND refers to the larger one of the ITD JND of the target source and the ITD JND of the interfering source. This comparison identifies, for the determined interaural coherence, how resolvable the directions of the target source and the interfering source are by comparing the ITD difference with the ITD JNDs. An example of this comparison is discussed in greater detail below with reference to FIG. 5.

If the ITD difference is less (e.g., or equal to) than the maximum ITD JND, the audio controller sets 445 η to 0. Here, the directions of the target source and interfering source are not spatially resolvable when based on ITDs or at least insufficiently spatially resolvable for preservation of the binaural information of the interfering source. This results in the BMWF-N algorithm of Equations 1 and 2 being set to prioritize or maximize SNR and binaural information of the target source, as defined by Equations 6 and 7, respectively:

$$W_L=\arg\min\{\|X_L-W_L^H X\|^2+\mu\|W_L^H V\|^2\} \tag{6}$$

$$W_R=\arg\min\{\|X_R-W_R^H X\|^2+\mu\|W_R^H V\|^2\} \tag{7}$$

When μ=0, much interferer/noise is removed as possible without introducing distortions to the target source. In other words, SNR is maximized with the constraint of not distorting the target source. When $\mu=f(SD)$ and $\eta=0$, SNR is maximized without the distortionless constraint. Distortions are introduced to the target source that will affect its binaural information. The binaural information of the interferer source is not preserved.

Figure 6:
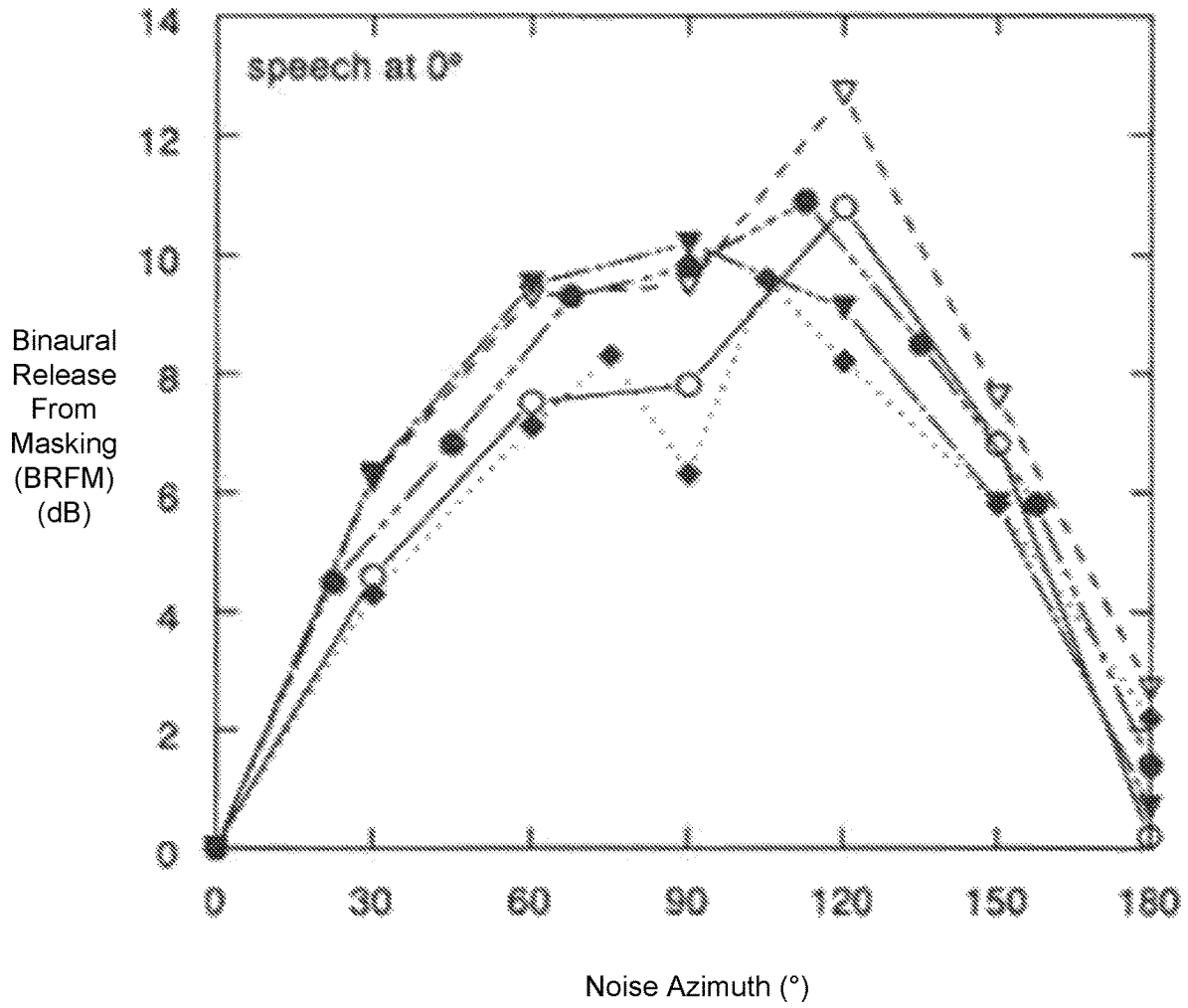
FIG. 6 is a graph of relationships between an interfering source at different noise azimuths relative to a 0 degree desired source and binaural release from masking values, in accordance with one or more embodiments.

If the ITD difference is greater than the maximum ITD JND, the audio controller determines 450 a binaural release from masking (BRFM) of the target and interfering sources based on the DOA of the target source and the DOA of the interfering source. The BRFM is the increase in SNR one gains from spatially separating the target source from the interferer source relative to both sources co-located in space. BRFM can be computed from angular separation. The audio controller determines an angular separation between the DOA of the target source and the DOA of the interfering source and determines the BRFM based on the angular separation. BRIM may be determined using a model that defines relationships between BRFM values to the angular separations. The audio system may store these relationships and use the stored relationships to determine the BRFM based on the measured angular separation. In general, BRFM (in dB) is smaller when the angular separation is at 0 degrees and 180 degrees, and larger when the angular separation is closer to 90 degrees. Example relationships between angular separation of target and interfering sources and the BRFM is shown in FIG. 6, which is discussed in greater detail below.

Figure 7:
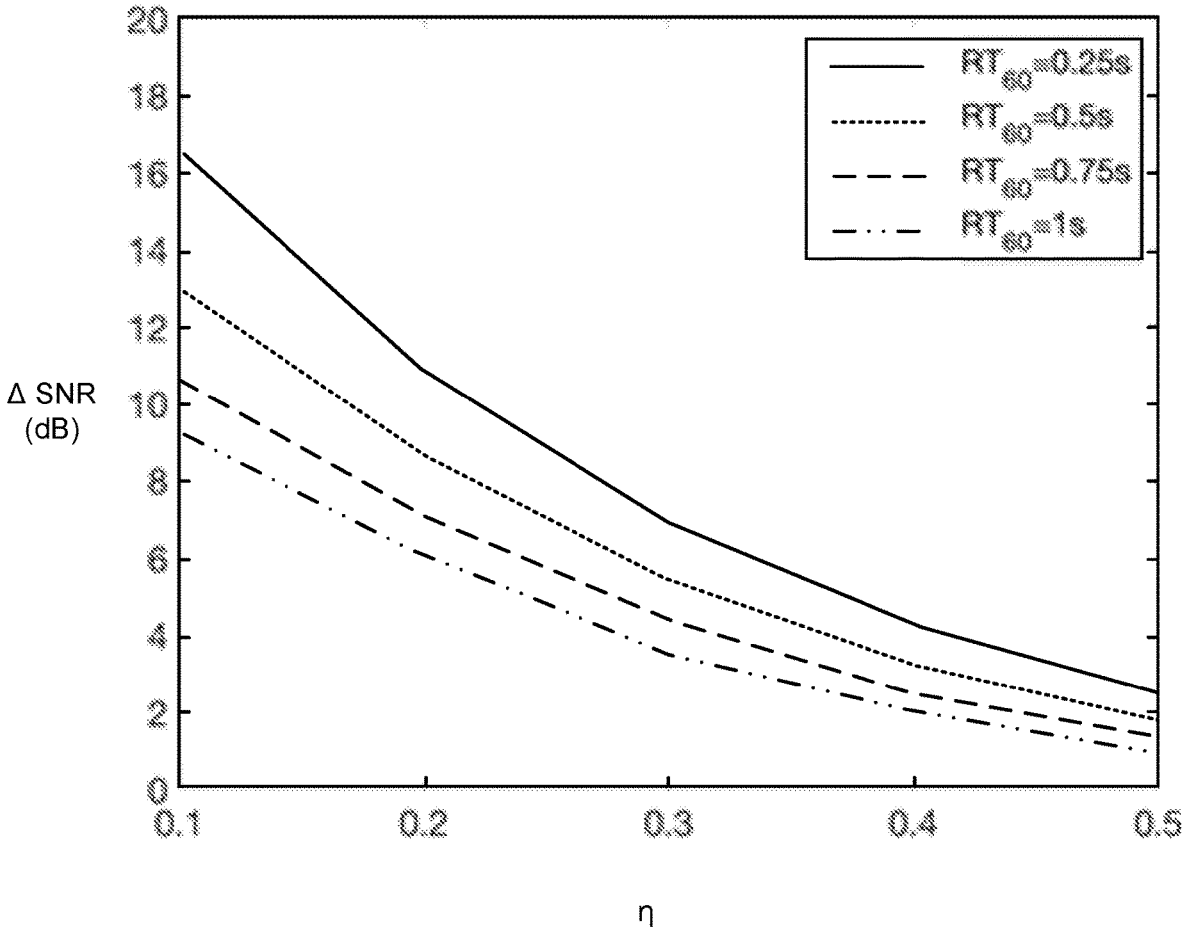
FIG. 7 is a graph of relationships between a parameter $\eta$ in a binaural multichannel Wiener filter with noise estimation algorithm and a SNR for different reverberation times, in accordance with one or more embodiments.

The audio controller determines 455 $\eta$ based on the interaural coherence, the BRFM, and a baseline SNR (e.g., for $\eta=0$). The parameter $\eta$ may be computed so that, for a particular interaural coherence, the sum of an expected SNR for $\eta$ and the BRFM is comparable to a baseline SNR. "Comparable," as used here, refers to the dB value of the sum of the expected SNR and the BRFM being equal to or within 3 db of the dB value for the baseline SNR. In some embodiments, the baseline SNR is 0 dB. In some embodiments, the sum of the expected SNR and q is equal to the baseline SNR. The computation of $\eta$ as a function of BRFM compensates for the negative effect that an increment in $\eta$ has on the baseline SNR (e.g., the SNR for $\eta=0$). For example, if the BRFM is 6 dB and the baseline SNR for $\eta=0$ is 14 dB, then the determined $\eta$ may be a value corresponding with an expected SNR of 8 dB. The relationships between expected SNR values and $\eta$ values may vary based on the interaural coherence (which is inversely related to reverberation time). The audio system may store these relationships and use the stored relationships to determine $\eta$ based on the measured BRFM and interaural coherence and target baseline SNR. These relationships are shown in FIG. 7 and discussed in greater detail below.

The parameter $\eta$ is also a function of ITD JND based on the calculation of $\eta$ being dependent on the comparison at step 440 involving the ITD JNDs of the target and interfering sources.

FIG. 5 is a graph 500 of relationships between interaural coherence and ITD JND for different ITDs, in accordance with one or more embodiments. The graph 500 is an example of data that may be used to determine ITD JND given an interaural coherence (IC). ITD JND values (μs) are plotted along the y-axis as a function of IC, plotted along the x-axis, and ITD values, represented by different lines. For any given ITD, the ITD JND decreases as the interaural coherence increases (e.g., from 0.8 to 1). Furthermore, the ITD JND increases for increasing ITD for any given IC value. The ITD JND values as a function of IC and ITD shown in the graph 500 are applicable to each of the target source and the interfering source.

The graph 500 may also be used to determine if ITD difference between the target source and the interfering source is greater than or less than a maximum ITD JND of the target source and the interfering source. For example, the direction of the target source may have an ITD of 0 microseconds (μs) and the direction of the interfering has an ITD of 200 μs (or the other way around), and for an IC=0.92, the ITD difference between the 2 directions (i.e. 200 μs), is larger than their corresponding ITD JNDs (about 39 μs for a ref.ITD=0 μs and about 60 microsec for ref.ITD=200 μs), indicating that both directions are resolvable for IC=0.92. For ITD JNDs not empirically acquired, a linear relation between IC and ITD JND may be used as a reasonable approximation across different reference ITDs.

FIG. 6 is a graph 600 of relationships between an interfering source at different noise azimuths relative to a 0 degree target source and binaural release from masking (BRFM) values, in accordance with one or more embodiments. In graph 600, the target source is at 0 degrees and the azimuth angle of the interfering source, which is thus equivalent to the angular separation between the target source and the interfering source is plotted along the x-axis. The BRFM (in dB) is plotted along the y-axis. As shown, the BRFM varies with the angular separation, with BRFM being smaller when the angular separation is at 0 degrees and 180 degrees, and larger when the angular separation is closer to 90 degrees. Each line in graph 600 represents results from different studies in the literature.

FIG. 7 is a graph 700 of relationships between a parameter $\eta$ in the BMWF-N algorithm and an SNR for different reverberation times, in accordance with one or more embodiments. Values for $\eta$ are plotted along the x-axis and values for SNR (dB) are plotted along the y-axis. The different lines represent different reverberation times, corresponding with the different interaural coherences. Smaller interaural coherences correspond with larger reverberation times.

The relationships in graphs 600 and 700 may be used to determine $\eta$. For example, if the direction of the target source is in front (e.g., 0 degree and ITD=0 μs), and the direction of the interfering source is about 45 degrees azimuth, the graph 600 of FIG. 6 indicates an expected BRFM of about 6 to 8 dB. For a high interaural coherence (e.g., corresponding to a low reverberation time RT60=0.25 seconds as shown in graph 700 of FIG. 7), the expected SNR for $\eta=0.3$ (e.g., approximately 8 dB) combined with the BRFM (e.g., 6 to 8 dB) will result in a net SNR of about 14 to 16 dB. The SNR of 14 to 16 dB is comparable to the SNR achieved with $\eta=0.1$ (i.e., $\eta$ at or close to 0). As such, $\eta$ is determined as 0.3 in this example. This results in a better preservation of the binaural information of the interfering source than using 1=0 or near 0, while also achieving some noise reduction In general, the higher the $\eta$ value, the better the preservation of the interfering source's binaural information.

Figure 8:
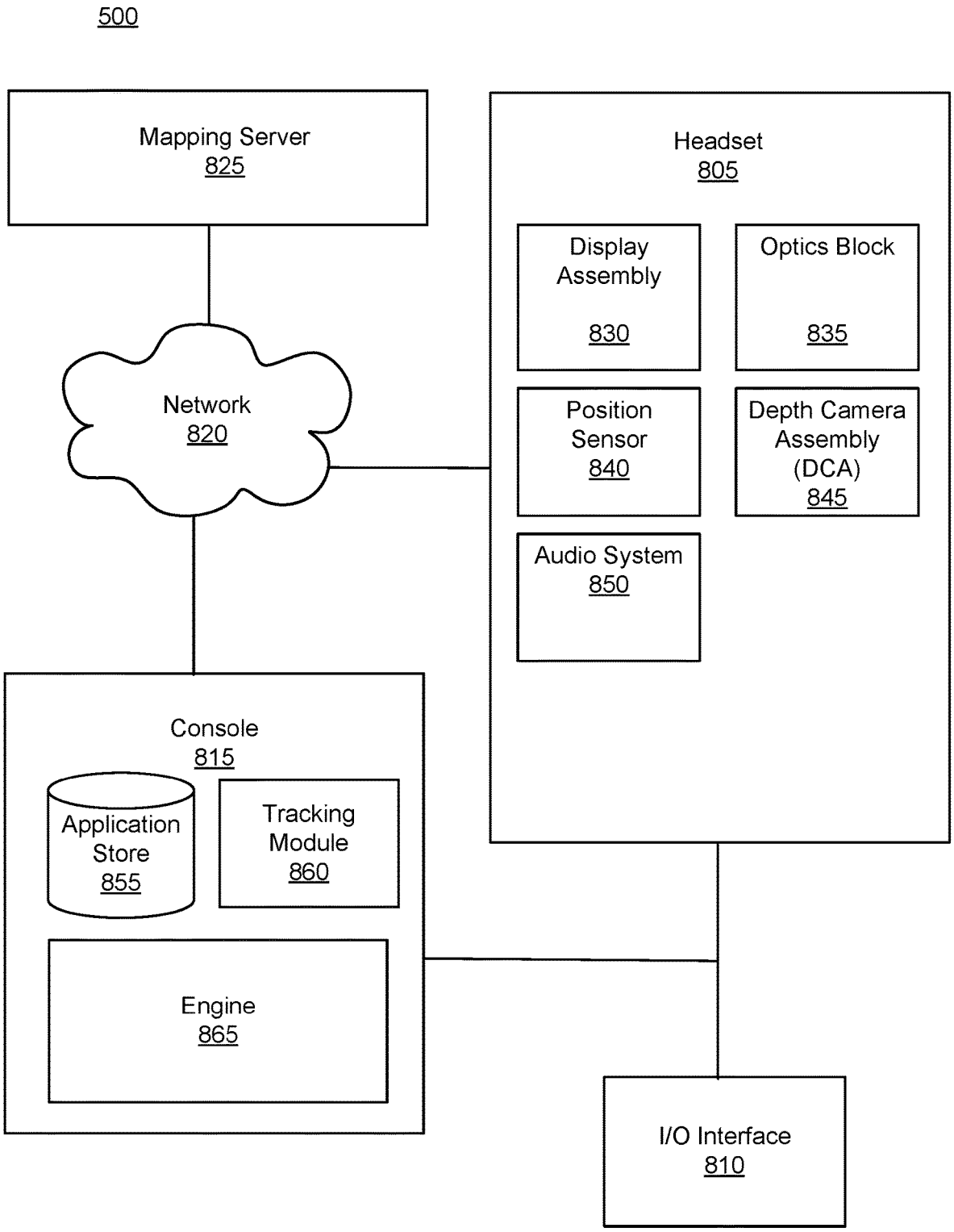
FIG. 8 is a system that includes a headset, in accordance with one or more embodiments.

FIG. 8 is a system 800 that includes a headset 805, in accordance with one or more embodiments. In some embodiments, the headset 805 may be the headset 100 of FIG. 1A or the headset 105 of FIG. 1B. The system 800 may operate in an artificial reality environment (e.g., a virtual reality environment, an augmented reality environment, a mixed reality environment, or some combination thereof). The system 800 shown by FIG. 8 includes the headset 805, an input/output (I/O) interface 810 that is coupled to a console 815, the network 820, and the mapping server 825. While FIG. 8 shows an example system 800 including one headset 805 and one I/O interface 810, in other embodiments any number of these components may be included in the system 800. For example, there may be multiple headsets each having an associated I/O interface 810, with each headset and I/O interface 810 communicating with the console 815. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 815 may be provided by the headset 805.

The headset 805 includes the display assembly 830, an optics block 835, one or more position sensors 840, and the DCA 845. Some embodiments of headset 805 have different components than those described in conjunction with FIG. 8. Additionally, the functionality provided by various components described in conjunction with FIG. 8 may be differently distributed among the components of the headset 805 in other embodiments, or be captured in separate assemblies remote from the headset 805.

The display assembly 830 displays content to the user in accordance with data received from the console 815. The display assembly 830 displays the content using one or more display elements (e.g., the display elements 120). A display element may be, e.g., an electronic display. In various embodiments, the display assembly 830 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 835.

The optics block 835 may magnify image light received from the electronic display, corrects optical errors associated with the image light, and presents the corrected image light to one or both eyeboxes of the headset 805. In various embodiments, the optics block 835 includes one or more optical elements. Example optical elements included in the optics block 835 include: an aperture, a Fresnel lens, a convex lens, a concave lens, a filter, a reflecting surface, or any other suitable optical element that affects image light. Moreover, the optics block 835 may include combinations of different optical elements. In some embodiments, one or more of the optical elements in the optics block 835 may have one or more coatings, such as partially reflective or anti-reflective coatings.

Magnification and focusing of the image light by the optics block 835 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 835 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 835 corrects the distortion when it receives image light from the electronic display generated based on the content.

The position sensor 840 is an electronic device that generates data indicating a position of the headset 805. The position sensor 840 generates one or more measurement signals in response to motion of the headset 805. The position sensor 190 is an embodiment of the position sensor 840. Examples of a position sensor 840 include: one or more IMUs, one or more accelerometers, one or more gyroscopes, one or more magnetometers, another suitable type of sensor that detects motion, or some combination thereof. The position sensor 840 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 805 from the sampled data. For example, the IMU integrates the measurement signals received from the accelerometers over time to estimate a velocity vector and integrates the velocity vector over time to determine an estimated position of a reference point on the headset 805. The reference point is a point that may be used to describe the position of the headset 805. While the reference point may generally be defined as a point in space, however, in practice the reference point is defined as a point within the headset 805.

The DCA 845 generates depth information for a portion of the local area. The DCA includes one or more imaging devices and a DCA controller. The DCA 845 may also include an illuminator. Operation and structure of the DCA 845 is described above with regard to FIG. 1A.

The audio system 850 provides audio content to a user of the headset 805. The audio system 850 is substantially the same as the audio system 200 describe above. For example, the audio system 850 enhances an audio signal based on the interaural coherence and other parameters of detected sounds in a local area. The audio system 850 may comprise one or acoustic sensors, one or more transducers, and an audio controller. The audio system 850 may provide spatialized audio content to the user. In some embodiments, the audio system 850 may request acoustic parameters from the mapping server 825 over the network 820. The acoustic parameters describe one or more acoustic properties (e.g., room impulse response, a reverberation time, a reverberation level, etc.) of the local area. The audio system 850 may provide information describing at least a portion of the local area from e.g., the DCA 845 and/or location information for the headset 805 from the position sensor 840. The audio system 850 may generate one or more sound filters using one or more of the acoustic parameters received from the mapping server 825, and use the sound filters to provide audio content to the user.

The I/O interface 810 is a device that allows a user to send action requests and receive responses from the console 815. An action request is a request to perform a particular action. For example, an action request may be an instruction to start or end capture of image or video data, or an instruction to perform a particular action within an application. The I/O interface 810 may include one or more input devices. Example input devices include: a keyboard, a mouse, a game controller, or any other suitable device for receiving action requests and communicating the action requests to the console 815. An action request received by the I/O interface 810 is communicated to the console 815, which performs an action corresponding to the action request. In some embodiments, the I/O interface 810 includes an IMU that captures calibration data indicating an estimated position of the I/O interface 810 relative to an initial position of the I/O interface 810. In some embodiments, the I/O interface 810 may provide haptic feedback to the user in accordance with instructions received from the console 815. For example, haptic feedback is provided when an action request is received, or the console 815 communicates instructions to the I/O interface 810 causing the I/O interface 810 to generate haptic feedback when the console 815 performs an action.

The console 815 provides content to the headset 805 for processing in accordance with information received from one or more of: the DCA 845, the headset 805, and the I/O interface 810. In the example shown in FIG. 8, the console 815 includes an application store 855, a tracking module 860, and an engine 865. Some embodiments of the console 815 have different modules or components than those described in conjunction with FIG. 8. Similarly, the functions further described below may be distributed among components of the console 815 in a different manner than described in conjunction with FIG. 8. In some embodiments, the functionality discussed herein with respect to the console 815 may be implemented in the headset 805, or a remote system.

The application store 855 stores one or more applications for execution by the console 815. An application is a group of instructions, that when executed by a processor, generates content for presentation to the user. Content generated by an application may be in response to inputs received from the user via movement of the headset 805 or the I/O interface 810. Examples of applications include: gaming applications, conferencing applications, video playback applications, or other suitable applications.

The tracking module 860 tracks movements of the headset 805 or of the I/O interface 810 using information from the DCA 845, the one or more position sensors 840, or some combination thereof. For example, the tracking module 860 determines a position of a reference point of the headset 605 in a mapping of a local area based on information from the headset 805. The tracking module 860 may also determine positions of an object or virtual object. Additionally, in some embodiments, the tracking module 860 may use portions of data indicating a position of the headset 805 from the position sensor 840 as well as representations of the local area from the DCA 845 to predict a future location of the headset 805. The tracking module 860 provides the estimated or predicted future position of the headset 805 or the I/O interface 810 to the engine 865.

The engine 865 executes applications and receives position information, acceleration information, velocity information, predicted future positions, or some combination thereof, of the headset 805 from the tracking module 860. Based on the received information, the engine 865 determines content to provide to the headset 805 for presentation to the user. For example, if the received information indicates that the user has looked to the left, the engine 865 generates content for the headset 805 that mirrors the user's movement in a virtual local area or in a local area augmenting the local area with additional content. Additionally, the engine 865 performs an action within an application executing on the console 815 in response to an action request received from the I/O interface 810 and provides feedback to the user that the action was performed. The provided feedback may be visual or audible feedback via the headset 805 or haptic feedback via the I/O interface 810.

The network 820 couples the headset 805 and/or the console 815 to the mapping server 825. The network 820 may include any combination of local area and/or wide area networks using both wireless and/or wired communication systems. For example, the network 820 may include the Internet, as well as mobile telephone networks. In one embodiment, the network 820 uses standard communications technologies and/or protocols. Hence, the network 820 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 820 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 820 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 825 may include a database that stores a virtual model describing a plurality of spaces, wherein one location in the virtual model corresponds to a current configuration of a local area of the headset 805. The mapping server 825 receives, from the headset 805 via the network 820, information describing at least a portion of the local area and/or location information for the local area. The user may adjust privacy settings to allow or prevent the headset 805 from transmitting information to the mapping server 825. The mapping server 825 determines, based on the received information and/or location information, a location in the virtual model that is associated with the local area of the headset 805. The mapping server 825 determines (e.g., retrieves) one or more acoustic parameters associated with the local area, based in part on the determined location in the virtual model and any acoustic parameters associated with the determined location. The mapping server 825 may transmit the location of the local area and any values of acoustic parameters associated with the local area to the headset 805.

One or more components of system 800 may contain a privacy module that stores one or more privacy settings for user data elements. The user data elements describe the user or the headset 805. For example, the user data elements may describe a physical characteristic of the user, an action performed by the user, a location of the user of the headset 805, a location of the headset 805, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list"

of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 800 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a nontransitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a nontransitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method, comprising, by one or more processors:

detecting, via an acoustic sensor array, sounds from a local area;

determining an interaural coherence using the detected sounds;

determining a parameter $\mu$ that controls a tradeoff between signal-to-noise ratio (SNR) and sound distortion;

determining a parameter $\eta$ that controls preserving of binaural information of an interfering source based on the interaural coherence;

generating sound filters for an audio signal based on the parameters $\mu$ and $\eta$, the sound filters implementing a tradeoff between increasing the SNR between a target source and the interfering source and preserving of the binaural information of the interfering source, tradeoff being controlled based on the interaural coherence;

applying the sound filters to the audio signal to generate audio content; and presenting, via a speaker array, the audio content.

2. The method of claim 1, wherein the sound filters each includes a binaural multichannel Wiener filter with noise estimation.

3. The method of claim 1, further comprising, by the one or more processors:

responsive to the interaural coherence being less than a threshold value, setting the parameter $\mu$ such that the sound filters include a binaural minimum-variance distortion-less response; and responsive to interaural coherence being greater than the threshold value, setting the parameter μ as a function of tolerated sound distortion.

4. The method of claim 1, further comprising, by the one or more processors, determining η based on a first interaural time difference (ITD) of the target source, a first ITD just noticeable difference (JND) of the target source, a second ITD of the interfering source, and a second ITD JND of the interfering source.

5. The method of claim 4, wherein determining η comprises:

determining, for the interaural coherence, an ITD difference between the first ITD and the second ITD;

determining a maximum ITD JND of the first ITD JND and the second ITD JND; and responsive to the ITD difference being less than the maximum ITD JND, setting η to maximize increasing SNR and minimize preserving of the binaural information of the interfering source.

6. The method of claim 4, wherein determining η includes:

determining, for the interaural coherence, an ITD difference between first ITD and the second ITD;

determining a maximum ITD JND of the first ITD JND and the second ITD JND; and responsive to the ITD difference being greater than the maximum ITD JND, setting η based on:

determining an angular separation between a first direction of arrival (DOA) of the target source and a second DOA of the interfering source;

determining a binaural release from masking (BRFM) of the target and interfering sources based on the angular separation; and determining such that, for the interaural coherence, a sum of an expected SNR for η and the BRFM is within 3 dB of a baseline SNR.

7. The method of claim 6, wherein the baseline SNR is 0 dB and the sum of the expected SNR and η is equal to the baseline SNR.

8. The method of claim 1, wherein the interaural coherence is determined using a subband of the detected sounds and the sound filters are applied to the subband of the audio signal.

9. A device, comprising:

an acoustic sensor array configured to detect sounds from a local area;

a speaker array;

one or more processors; and a memory storing program code that, when executed by the one or more processors, configures the one or more processors to:

determine an interaural coherence using the detected sounds;

determine a parameter μ that controls a tradeoff between signal-to-ratio (SNR) and sound distortion;

determine a parameter η that controls preserving of binaural information of an interfering source based on an interaural coherence;

generate sound filters for an audio signal based in part on the parameters μ and η, the sound filters implementing a tradeoff between increasing the SNR between a target source and the interfering source and preserving of the binaural information of the interfering source, tradeoff being controlled based on the interaural coherence;

apply the sound filters to the audio signal to generate audio content; and present, via the speaker array, the audio content.

10. The device of claim 9, wherein the sound filters each includes a binaural multichannel Wiener filter with noise estimation.

11. The device of claim 9, wherein the program code further configures the one or more processors for:

responsive to the interaural coherence being less than a threshold value, setting the parameter μ such that the sound filters include a binaural minimum-variance distortion-less response; and responsive to interaural coherence being greater than the threshold value, setting the parameter μ as a function of tolerated sound distortion.

12. The device of claim 9, wherein the program code further configures the one or more processors for, determining η based on:

determining, for the interaural coherence, an interaural time difference (ITD) difference between a first ITD of the target source and a second ITD of the interfering source;

determining a maximum ITD just noticeable difference (JND) of a first ITD JND of the target source and a second ITD JND of the interfering source; and responsive to the ITD difference being less than the maximum ITD JND, setting η to maximize increasing SNR and minimize preserving of the binaural information of the interfering source.

13. The device of claim 9, wherein the program code further configures the one or more processors for, determining η based on:

determining, for the interaural coherence, an interaural time difference (ITD) difference between a first ITD of the target source and a second ITD of the interfering source;

determining a maximum ITD just noticeable difference (JND) of a first ITD JND of the target source and a second ITD JND of the interfering source; and responsive to the ITD difference being less than the maximum ITD JND, setting η based on:

determining an angular separation between a first direction of arrival (DOA) of the target source and a second DOA of the interfering source;

determining a binaural release from masking (BRFM) of the target and interfering sources based on the angular separation; and determining such that, for the interaural coherence, a sum of an expected SNR for η and the BRFM is within 3 dB of a baseline SNR.

14. The device of claim 13, wherein the baseline SNR is 0 dB and the sum of the expected SNR and η is equal to the baseline SNR.

15. The device of claim 9, wherein the interaural coherence is determined using a subband of the detected sounds and the sound filters are applied to the subband of the audio signal.

16. A non-transitory computer-readable storage medium comprising stored program code that, when executed by one or more processors of an audio system, causes the audio system to:

detect, via an acoustic sensor array, sounds from a local area;

determine an interaural coherence using the detected sounds;

determine a parameter μ that controls a tradeoff between signal-to-noise ratio (SNR) and sound distortion;

determine a parameter η that controls preserving of binaural information of an interfering source based on the interaural coherence;

generate sound filters for an audio signal based on the parameters μ and η, the sound filters implementing a tradeoff between increasing the SNR between a target source and the interfering source and preserving of the binaural information of the interfering source, tradeoff being controlled based on the interaural coherence;

apply the sound filters to the audio signal to generate audio content; and present, via a speaker array, the audio content.

17. The non-transitory computer-readable storage medium of claim 16, wherein the sound filters each includes a binaural multichannel Wiener filter with noise estimation.

18. The non-transitory computer-readable storage medium of claim 16, further comprising stored program code that, when executed by one or more processors of an audio system, causes the audio system to:

responsive to the interaural coherence being less than a threshold value, set the parameter μ such that the sound filters include a binaural minimum-variance distortion-less response; and responsive to interaural coherence being greater than the threshold value, set the parameter μ as a function of tolerated sound distortion.

19. The non-transitory computer-readable storage medium of claim 16, further comprising stored program code that, when executed by one or more processors of an audio system, causes the audio system to:

determine η based on a first interaural time difference (ITD) of the target source, a first ITD just noticeable difference (JND) of the target source, a second ITD of the interfering source, and a second ITD JND of the interfering source.

20. The non-transitory computer-readable storage medium of claim 19, further comprising stored program code that, when executed by one or more processors of an audio system, causes the audio system to:

determine, for the interaural coherence, an ITD difference between the first ITD and the second ITD;

determine a maximum ITD JND of the first ITD JND and the second ITD JND; and responsive to the ITD difference being less than the maximum ITD JND, set η to maximize increasing SNR and minimize preserving of the binaural information of the interfering source.

* * * * *